US005341753A

United States Patent [19]

Russell

[11] Patent Number: 5,341,753

[45] Date of Patent: Aug. 30, 1994

[54] CIRCULATING FLUIDIZED BED POWER PLANT WITH IMPROVED MIXING OF SORBENTS WITH COMBUSTION GASES

[75] Inventor: David B. Russell, San Diego, Calif.

[73] Assignee: Pyropower Corporation, San Diego, Calif.

[21] Appl. No.: 16,847

[22] Filed: Feb. 12, 1993

[51] Int. Cl.[5] ..... F22B 1/02

[52] U.S. Cl. ..... 122/4 D; 110/245; 432/58

[58] Field of Search ..... 110/245; 122/4 D; 432/15, 58

[56] References Cited

U.S. PATENT DOCUMENTS

| | | | |
|---|---|---|---|
| 4,424,766 | 1/1984 | Boyle | 122/4 D |
| 4,555,996 | 12/1985 | Torbov et al. | 110/345 |
| 4,639,209 | 1/1987 | Grethe | 431/4 |
| 5,054,436 | 10/1991 | Dietz | 122/4 D |
| 5,105,747 | 4/1992 | Khinkis et al. | 110/245 |
| 5,141,708 | 8/1992 | Campbell, Jr. et al. | 122/4 D |
| 5,242,662 | 9/1993 | Toth | 110/245 |

*Primary Examiner*—Henry C. Yuen

*Attorney, Agent, or Firm*—Baker, Maxham, Jester & Meador

[57] ABSTRACT

A circulating fluidized bed combustor comprises a fluidized bed combustion chamber, a recirculating system for recirculating fluidized solids through the combustion chamber, and a plurality of fluid injection nozzles disposed around the walls of the combustion chamber above the loop seal returns for injecting a high velocity fluid for improved mixing gases and solids in the combustion chamber.

9 Claims, 4 Drawing Sheets

CIRCULATING FLUIDIZED BED POWER PLANT WITH IMPROVED MIXING OF SORBENTS WITH COMBUSTION GASES

BACKGROUND OF THE INVENTION

The present invention relates to power plants and pertains particularly to improved apparatus for improving mixing of sorbents with combustion gases in circulating fluidized bed (CFB) boiler plants to lower sulfur dioxide levels in the flue gas.

There exists in the power generating industry a need for more efficient power plants for converting fossil fuels to electrical power. The need is even greater for higher efficiency plants for converting lower grades of sulfur containing fuels, such as coal, that exist in abundance in many regions of the world.

Atmospheric pollution is of great concern throughout the world today. One of the major causes of atmospheric pollution is the burning of various fossil fuels for the generation of heat and power. Many of these fuels contain impurities, such as sulfur which reacts in the combustion process forming compounds such as $SO_2$ that is particularly noxious and polluting. Systems, including scrubbers, have been developed for removing these pollutants from exhaust gases of power plants. However, these systems are very expensive and frequently not cost effective for most power plants.

Circulating fluidized bed combustors have been developed in recent years for burning low quality fuels, such as coals, for generating steam for powering steam turbines. The circulating fluidized bed combustor features a mixture of granular limestone or other sorbent materials supported on a non-sifting grid. An upward flow of air passes through the grid lifting and fluidizing the material. This results in a turbulent mixture of the bed particles having the free flowing properties of a liquid and providing an environment for stable combustion. Fuels introduced into the bed will burn effectively, and sulfur dioxide released by the burning is chemically captured by the calcined limestone. The mixture of solids which includes ash and calcined limestone is recirculated through the combustor until the particle size is reduced sufficiently for elution through the cyclones.

As sulfur containing fuel is burned, the sulfur volatilizes under the high temperatures and combusts with oxygen to form sulfur dioxide. The limestone is calcined by the combustion temperatures, and the sulfur dioxide then reacts with the calcium oxide and oxygen to form calcium sulfate. The oxygen and sulfur are contained in the gas of the fluidized stream, and the calcium oxide is contained in the particles. Sulfur removal depends on contact between the sulfur dioxide molecules and the calcium oxide particles.

Recent studies have shown that as combustion and recirculation occurs the calcined limestone particles are transported up through the combustor with little or no turbulence except near the walls of the combustor. The sulfur dioxide was found to be more highly concentrated in the center of the combustor, with lowered sulfide dioxide levels in the flue gas near the combustor walls. This phenomenon has been described as a "sulfur dome" when traverse readings are taken across an operating CFB combustor. This distribution leads to the requirement of more transverse circulation of the particles and combustion gases in the combustor to lower sulfur dioxide levels in the flue gas.

The calcium sulfur ratio (Ca/S) required for a desired amount of sulfur removal is a function of how much excess particle density in the gas stream is required to insure that a sufficient number of sulfur dioxide molecules come in contact with the calcium dioxide particles. It is, therefore, desirable to improve the contact between the calcium and the sulfur dioxide particles.

Applicant has discovered and developed an arrangement whereby a circulating fluidized bed (CFB) for burning sulfur containing fuels is made to utilize limestone more efficiently by the injection of high velocity steam into the circulating fluidized bed (CFB) boiler to improve the mixing of the recirculating solids with the combustion gases.

SUMMARY OF OBJECTS OF THE INVENTION

It is the primary object of the present invention to provide an improved circulating fluidized bed (CFB) combustor having a higher efficiency sulfur dioxide reduction system.

In accordance with a primary aspect of the present invention, a power plant having a circulating fluidized bed (CFB) boiler is provided with high velocity steam injection nozzles just above the loop seal return in the combustion chamber for creating cross flow and improved mixing of the combustion gases with the recirculating solids.

BRIEF DESCRIPTION OF THE DRAWING

The above and other objects and advantages of the present invention will become apparent from the following description when read in conjunction with the accompanying drawings wherein.

DETAILED DESCRIPTION OF A PREFERRED EMBODIMENT

Figure 1:
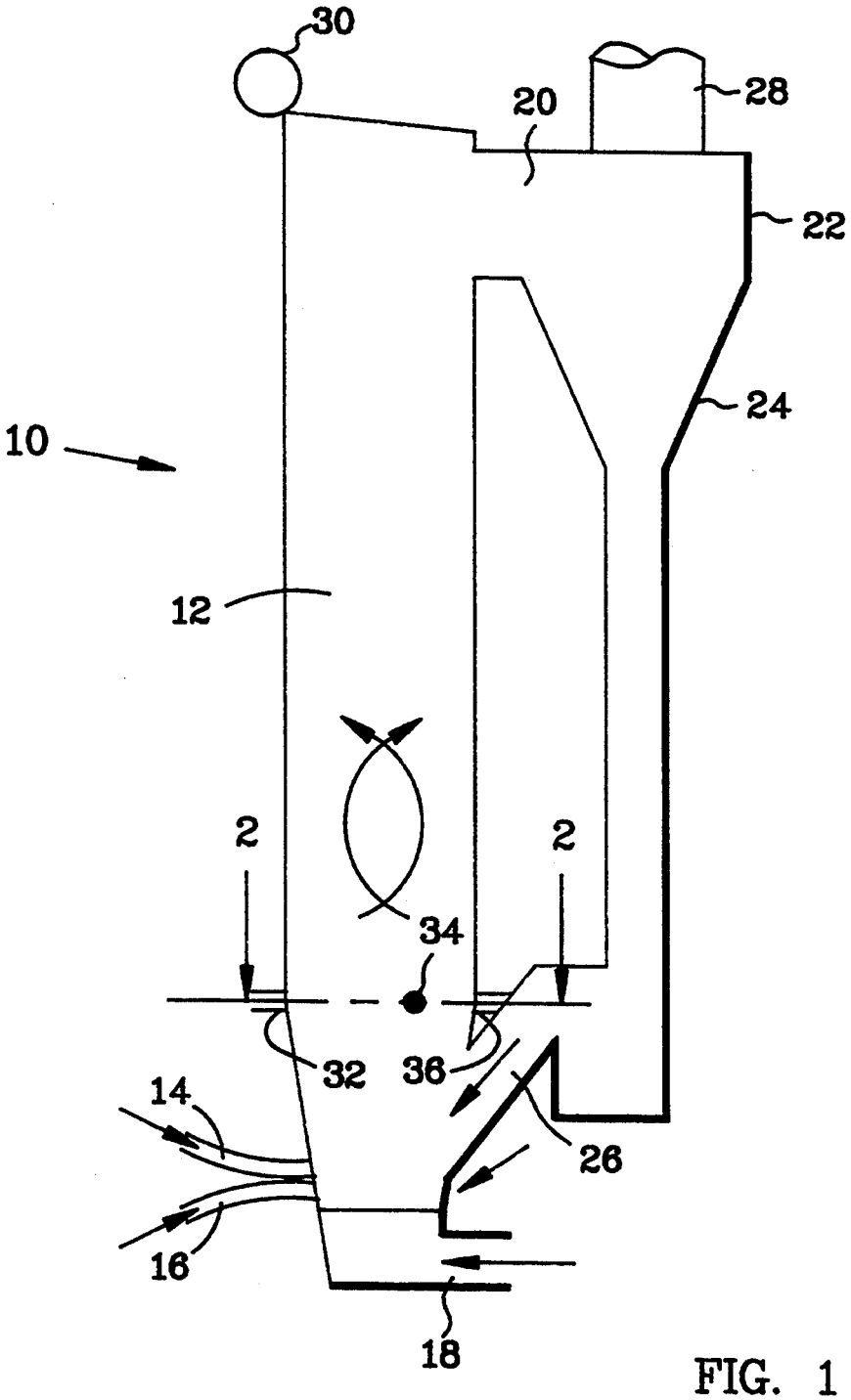
FIG. 1 is a schematic diagram illustrating a circulating fluidized bed combustion system in accordance with the present invention.

Referring to FIG. 1 of the drawing, there is schematically illustrated a circulating fluidized bed (CFB) power plant, designated generally by the numeral 10, of a generally conventional overall construction. The combustion chamber is of a vertical orientation and may be of either a circular or rectangular cross-section. The chamber is designed not only to stand a positive pressure but also to recover heat from combustion reactions by means of circulating water tubes lining the walls of the chamber. The lower section of the combustion chamber has many openings designed for the introduction of fuel, limestone, air, recycled particles and other functions. Fuel, for example, is fed to the unit through a looped seal connection at 14 from a coal feeder (not shown), with limestone and/or other sorbents fed via inlet at 16. Primary air, which typically comprises up to from sixty-five to seventy percent of the total air, is introduced at 18 up through lower grid nozzles.

Because of the turbulence in the circulating bed, the fuel mixes quickly with the bed materials and is carried up through the combustion chamber wherein the flue gases and circulating material are fed via an inlet duct 20 to a cyclone separator 22. The cyclone separator has a vortex chamber, the upper part of which is cylindrical, with a lower part 24 of a funnel shape. The cyclone separates the solids from the combustion gases and returns the solids, including any unburned fuel, through a non-mechanical loop sealed connection 26 back to the lower part of the combustion chamber.

Hot flue gases exit the top of the separator at 28 and pass through super heaters and economizers and air heaters and to a bag house or precipitator, not shown. Steam pipes or tubes within the combustion chamber are connected to a steam drum or collecting header 30.

The crushed limestone or sorbent that is fed into the combustion chamber preferably has a particle size under one-thousand microns, with a particle size of approximately one-hundred to three-hundred microns. Calcium to sulfur molar ratios of 1.5 to 5, depending on limestone reactivity and fuel sulfur content, have been found to normally provide a suitable sulfur capture. However, the present invention is able to achieve satisfactory results at lower molar ratios. Thus, lower volumes of ash are produced and less limestone is required.

Figure 2:
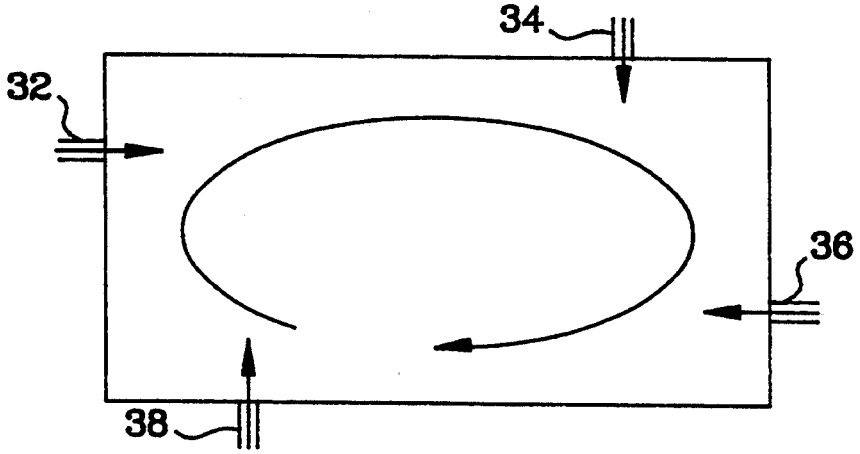
FIG. 2 is a sectional view taken on line 2—2 of FIG. 1 illustrating an exemplary nozzle arrangement.

In accordance with the present invention, as applied to a rectangular chamber having unequal sides illustrated in FIG. 2, a plurality of steam injection nozzles 32, 34 36 and 38 are provided in the walls of the combustion chamber just above loop seal return 26. The steam injection nozzles are arranged in a pattern, such as illustrated, to force transverse mixing in the combustion chamber. These injection nozzles may be positioned, as illustrated in FIG. 2, to one side of the center of the chamber and extend parallel to an adjacent side wall generating a single circular pattern of rotation for a generally rectangular combustion chamber of the configuration as illustrated. The steam is ejected from the nozzles substantially at sonic velocity, and the amount of steam ejected is about one to two percent of the total mass of combustion products in the combustion chamber.

As illustrated in FIG. 2, one nozzle is positioned and disposed for injecting steam along adjacent to and substantially parallel to the front, back and each side wall of the combustion chamber. These injection nozzles create a circular and turbulent motion, forcing the flow of products to mix with the recirculating material near the walls for a more through mixing of all of the products within the chamber. The injection nozzles are positioned above the loop seal returns where the sulfur dioxide concentration is likely to be highest due to the introduction of fuel just below this level.

The transverse displacement of the flue gases and solids within the chamber created by the steam injection causes more of the gas to cross the paths of the fluidized calcium oxidized particles, providing a more thorough contact between the gas and particles. This provides a more efficient reaction of the gases and calcium oxide particles, resulting in fewer excess particles required (Ca/S) to achieve the same levels of sulfur capture.

The injection nozzles, in accordance with the invention, increase the turbulence of the sulfur dioxide bearing gas across the plan area of the combustion chamber and provide a better contact of the calcium oxide particles and gas. This reduces or substantially eliminates the so-called "sulfur dome" by creating a more uniform and thorough mixing of the gases and particles across and within the combustion chamber.

Figure 3:
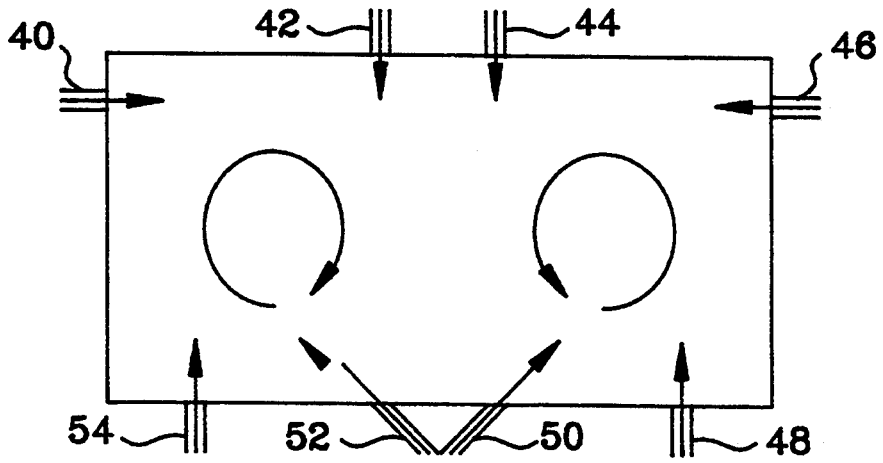
FIGS. 3–7 are views like FIG. 2 of alternate geometric configurations and nozzle arrangements.

Referring to FIG. 3, an alternate embodiment is illustrated wherein the injection nozzles are arranged to provide a double circulating pattern within the chamber. As illustrated in FIG. 3, an arrangement and pattern is established by a single nozzle 40 in one side wall, with a pair of nozzles 42 and 44 in an adjacent (front of back) wall close to the center thereof. Another single nozzle 46 is disposed in the opposing side wall at 46. The opposing (front or back) long wall is provided with four nozzles. A first nozzle 48 extends at ninety degrees or right angles to the wall near one end, with an adjacent nozzle 50 extending at an angle to the wall of about thirty to forty-five degrees. An adjacent mirror image arrangement is provided with an angled nozzle 52 near the center and a right angled nozzle 54 near the other end. This arrangement provides two adjacent counter-rotating patterns of circulation of the gases and particles within a rectangular chamber as illustrated. The nozzles are arranged around the chamber and oriented or directed across or transverse to the normal flow path for creating a rotating body of the material within a circle of rotation. The nozzles will be directed tangential to the circle of rotation formed. Thus, any number of arrangements of nozzles within the chamber may be provided.

Figure 4:
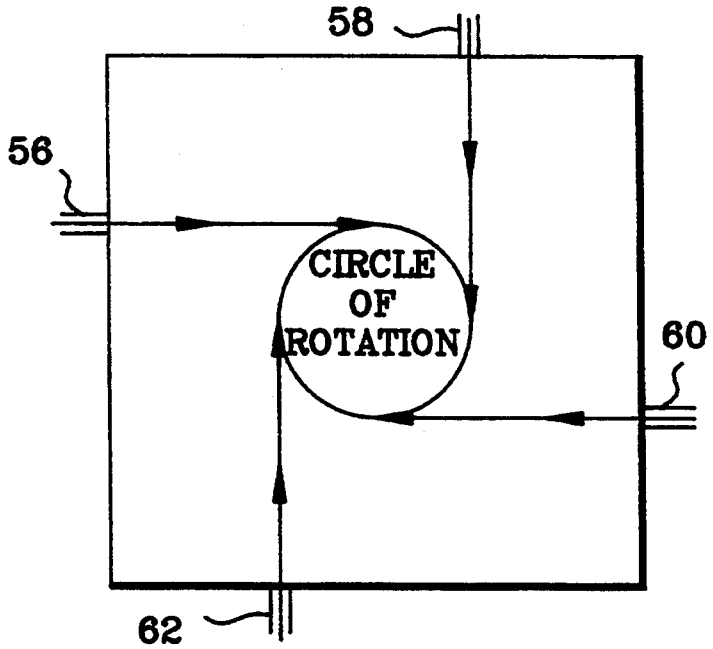

Referring to FIG. 4, an alternate embodiment is illustrated wherein the injection nozzles are arranged to provide a single circle of rotation circulating pattern within the center of a square chamber. As illustrated, a plurality of nozzles 56, 58, 60 and 62 are positioned at a ninety degree angle and offset from the center to each wall.

Figure 5:
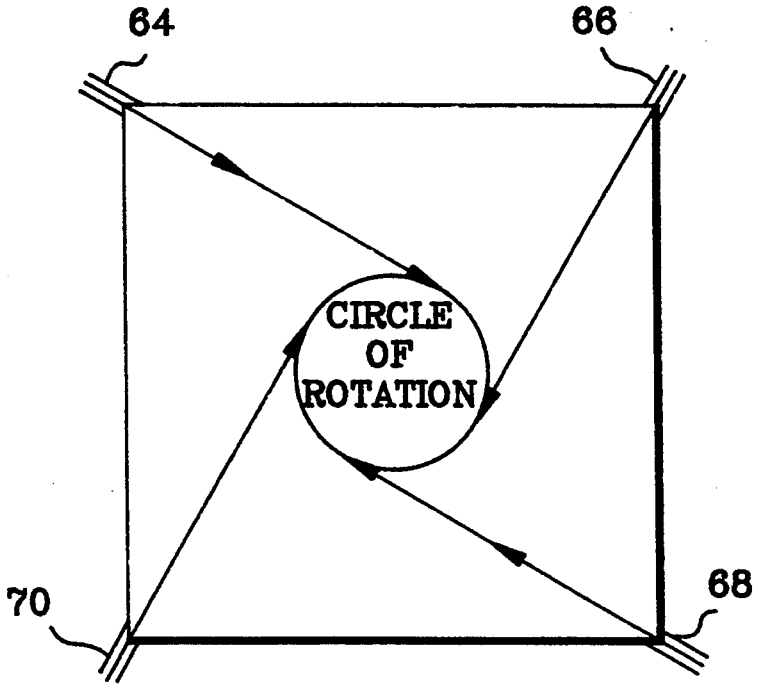

Referring to FIG. 5, a further arrangement of the injection nozzles is illustrated to provide a single circle of rotation circulating pattern within the center of a square chamber. In this embodiment, a plurality of nozzles 64, 66, 68 and 70 are positioned at the corners and at a forty-five degree angle to each wall.

Figure 6:
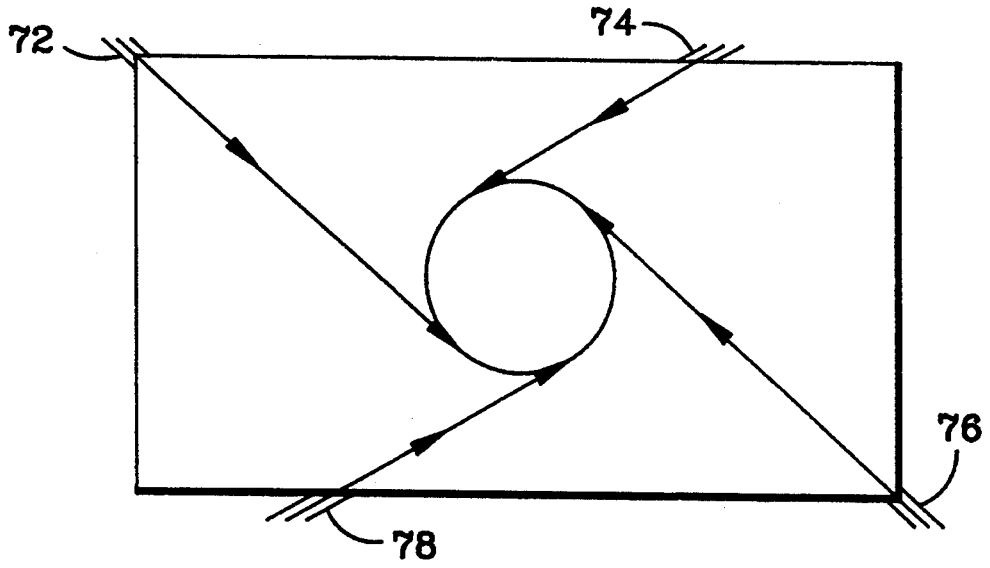
Figure 7:
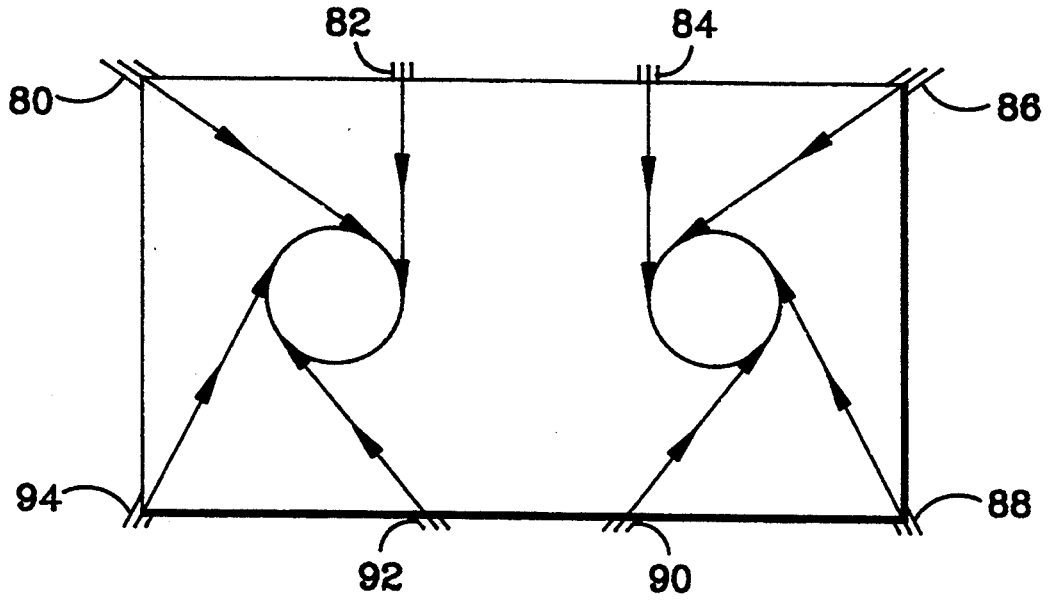

Referring to FIG. 6, another arrangement of the injection nozzles is illustrated to provide a single circle of rotation circulating pattern within the center of a rectangular chamber. In this embodiment, a plurality of nozzles 72, 74, 76 and 78 are positioned at the corners and at an angle of about forty-five degrees to each wall.

Referring to FIG. 6, a still further arrangement of the injection nozzles is illustrated to provide a double circle of rotation circulating pattern within the center of a rectangular chamber. In this embodiment, a plurality of nozzles 80, 82, 84 and 86 are positioned along one long side of the rectangular chamber. Two of the nozzles 80 and 86 at the corners are at about a forty-five degree angle. The two center nozzles are at about ninety degrees to the wall and about equally spaced from the corners and each other. Nozzles 88, 90, 92 and 94 are all at angles along the other long wall. The nozzles may be about equally spaced with nozzles 88 and 94 at the corners, and at an angle of about forty-five degrees to each wall.

It will also be apparent that the nozzles may be positioned in other different arrangements to obtain suitable patterns of rotation. It is understood that the term rectangular also embraces a square which is a rectangle with equal sides. In addition, it will be apparent that a chamber may have a circular cross-section or an oval cross-section. Such a chamber may be provided with a simple arrangement of nozzles to induce a circular flow of the gases and products within the chamber.

Other modifications and changes are possible in the foregoing disclosure and in some instances, some features may be employed without the corresponding use of other features. Accordingly, while the present invention has been illustrated and described with respect to specific embodiments, it is to be understood that numerous changes and modifications may be made therein without departing from the spirit and scope of the invention as defined in the appended claims.

I claim:

1. In a circulating fluidized bed combustor comprising;

a plurality of side walls defining a fluidized bed combustion chamber having a vertical orientation and a substantially rectangular cross-section;

recirculating means including a separator connected by conduct means to a return inlet for recirculating fluidized solids through the combustion chamber;

at least one nozzle disposed immediately above said return inlet for injecting steam outward from and adjacent to each side wall into said combustion chamber for inducing a circular flow of circulating material in said combustion chamber substantially perpendicular to the circulating flow as said circulating material flows upward through said chamber; and a source of high pressure steam for injecting at a high velocity through said nozzles for inducing said circular flow for improved mixing of gases and solids in said chamber.

2. A combustor according to claim 1 wherein said steam is injected through said nozzles substantially at sonic velocity.

3. A combustor according to claim 2 wherein the volume of steam injected is about one to two percent of the total mass of combustion product.

4. A combustor according to claim 1 wherein two of said side walls have a pair of nozzles near the center thereof for creating a pair of circular flows of said circulating material.

5. A combustor according to claim 1 wherein:

said combustion chamber has a substantially rectangular cross-section defined by a first pair of opposed long side walls and a second pair of opposed short side walls;

said short side walls each have one nozzle therein closely adjacent one of said long side walls for directing said steam along substantially parallel thereto;

one of said long sides have a pair of said nozzles therein near the center thereof oriented at substantially a right angle thereto; and the other of the long side walls have a first pair of nozzles oriented at a right angle to the wall, and a second pair of nozzles oriented at an angle to said side wall for inducing a pair of separate circular flows of circulating material in said combustion chamber.

6. A combustor according to claim 5 wherein said second pair of nozzles are disposed between said first pair of nozzles.

7. A combustor according to claim 1, wherein:

said steam is injected through said nozzles substantially at sonic velocity;

the volume of steam injected is about one to two percent of the total mass of combustion product; and two pair of nozzles are disposed in offset opposed pairs for inducing a circular flow of circulating material in said combustion chamber between said pairs of nozzles.

8. A combustor according to claim 1 wherein at least some of said nozzles are disposed at corners of said combustion chamber.

9. A combustor according to claim 8 wherein at least a pair of said nozzles are disposed in the sides of said chamber.

* * * * *